United States Patent [19]

Fiss

[11] 4,029,177

[45] June 14, 1977

[54] OVERSPEED BRAKE FOR A LIFT CAR

[75] Inventor: Robert A. Fiss, Red Wing, Minn.

[73] Assignee: International Telephone and Telegraph Corporation, New York, N.Y.

[22] Filed: July 30, 1976

[21] Appl. No.: 710,252

Related U.S. Application Data

[63] Continuation of Ser. No. 568,793, April 16, 1975, abandoned.

[52] U.S. Cl. ..... 187/89; 188/188; 188/189

[51] Int. Cl.² ..... B66B 5/24

[58] Field of Search ..... 187/2, 8, 13, 14, 73, 187/77, 81, 85–91; 182/142; 188/188, 189

[56] References Cited

UNITED STATES PATENTS

| | | | |
|---|---|---|---|
| 277,073 | 5/1883 | Singer | 187/90 X |
| 685,937 | 11/1901 | O'Neill et al. | 188/189 |
| 1,389,867 | 9/1921 | Griffin | 187/88 X |
| 2,943,708 | 7/1960 | Sasgen | 187/87 X |
| 3,119,464 | 1/1964 | Rountree | 187/89 |
| 3,250,348 | 5/1966 | Moyer | 188/188 |

*Primary Examiner*—Evon C. Blunk
*Assistant Examiner*—James L. Rowland
*Attorney, Agent, or Firm*—James B. Raden; William J. Michals

[57] ABSTRACT

A rotatable sheave is mounted on one end of a platform lift, enabling the sheave to be turned by friction of guide cables as the platform descends. Dogs attached to the sheave extend themselves due to centrifugal force as the platform moves faster. At a specified speed, the governor dogs impact an activating lever which in turn releases a spring loaded retainer rod assembly. The retainer rod assembly then releases spring loaded push rods that engage brake cam dogs on each end of the platform. The brake cam dogs squeeze the guide cables against clamp bodies halting descent of the platform.

8 Claims, 11 Drawing Figures

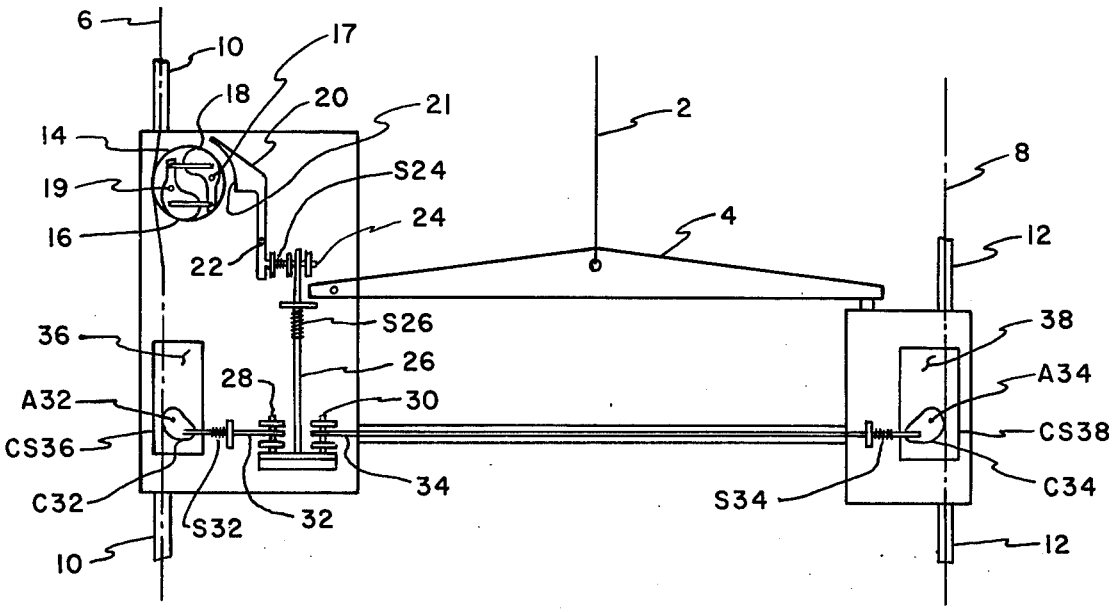
FIG. 1
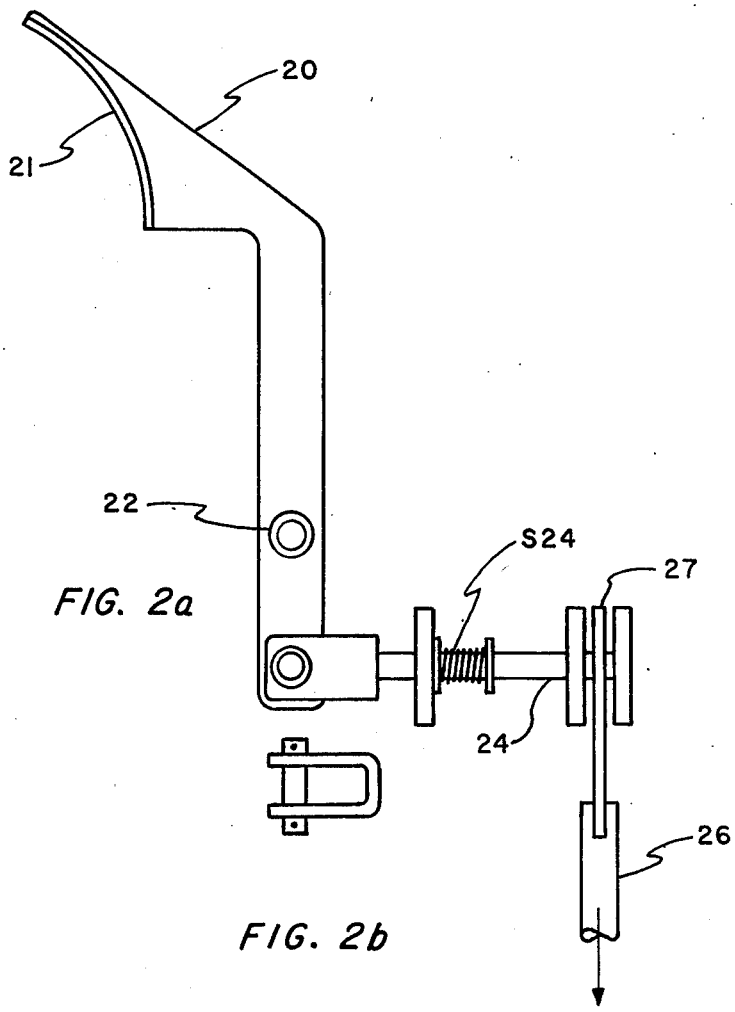
FIG. 2a
FIG. 2b

OVERSPEED BRAKE FOR A LIFT CAR

This is a continuation of application Ser. No. 568,793, filed Apr. 16, 1975, now abandoned.

BACKGROUND OF THE INVENTION

1. Field of the Invention

The invention relates to the safety of lift cars or lift platforms used for lifting men and materials to high elevations. It relates particularly to a system for detecting speed in such cars or platforms and to braking means for stopping the platform when the speed exceeds a safe maximum.

2. Description of the Prior Art

The prior art devices for lifting men and materials to high elevations, where indoor type elevators are not available, include a variety of forms of lifts or platforms. These platforms usually include a broken cable mechanism which senses a loss of tension in a lift cable indicating that the cable has broken and operates a brake mechanism to lock the platform to guide cables or the like and thus prevent a dangerous fall. Examples of elevators having brake mechanisms to stop a fall in the event a hoist cable is broken are to be found in patents to R. E. Meyer, U.S. Pat. Nos. 3,517,774 and 3,517,775.

There exist situations in which the platform could descend at an excessive speed while the lift cable or cables remain intact and continue to exert appropriate tensile forces on the broken cable mechanism. Such a situation may arise if a winch is faulty, allowing the lift cable to pay out rapidly. Excessive speed might also be reached if the lift cable broke at a point removed a long way from the platform, providing tension due to the counter-weight effect of cable weight over the hoist sheave which thereby prevents the broken cable device from activating.

SUMMARY OF THE INVENTION

An object of the invention is to provide a mechanism to guard against the possibilities of harm to personnel and damage to materials being lifted and to physical structures due to a lift platform falling at an excessive speed.

To attain the foregoing and related objects, a rotatable sheave is mounted on one end of the platform lift assembly in a position enabling the sheave to be driven by friction of guide cables as the platform descends. Dogs are attached to the sheave in such a way that they will extend themselves due to centrifugal force as the speed of the platform increases. At a specified speed, the governor dog extension will impact an activating lever which in turn releases a spring loaded retainer rod assembly. The retainer rod assembly then releases spring loaded push rods that engage brake cam dogs on each end of the platform. The brake cam dogs squeeze the guide cables against clamp bodies, halting descent of the platform.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which:

FIG. 1 is a schematic drawing showing an arrangement of components in accordance with a preferred embodiment of the invention.

FIGS. 2*a* and 2*b* show views of a portion of FIG. 1 depicting details of the actuating lever and the associated linkage.

DESCRIPTION OF PREFERRED EMBODIMENTS

Figure 3B:
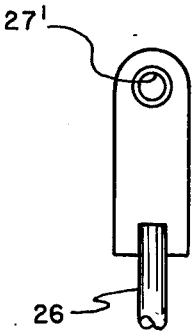
FIGS. 3*b* and 3*c* are left and right side views, respectively, of portions of the linkage of FIG. 3*a*.

Turn now to FIG. 1, for an overall view of an embodiment of the invention. It will be seen that a lift cable at 2 supports a lift bar 4 from which most of the remaining elements of the platform are supported ordinarily. Guide cables are indicated at 6 and 8 which serve principally as guide elements supported from above to aid in keeping the platform aligned as these cables pass through cable guides at 10 and 12. It will be recognized that the guide cables 6 and 8 may be replaced with rigid rails or the like without departing from the spirit of the invention.

As the platform is raised and lowered, an overspeed governor, or overspeed sheave, at 14 is turned about a central axis by the passage of guide cable 6 therethrough. When the platform travels within normal safe speeds, rotation of the sheave 14 produces no noticeable effects. When the platform moves at a speed in excess of some predetermined maximum, rotation of sheave 14 will cause spring-biased cam dogs at 16 and 18 to rotate about axes at 17 and 19 and to extend outward from the edge of the sheave to strike the surface 21 of actuating lever 20.

The actuating lever 20 when pushed with sufficient force by the cam dogs 16 and 18 will be caused to rotate about an axis at 22 against the force of a spring S24 to pull the rod 24 out of a bearing in the end of a rod 26. With the release of the rod 26, a spring S26 presses the rod 26 downward to drive pins at 28 and 30 free of bearings in the ends of horizontal rods 32 and 34 permitting each of those rods to be driven outward by the action of springs S32 and S34, respectively. Brake cams at C32 and C34 are then turned about axes at A32 and A34. This causes the guide cables 6 and 8 to be lodged between the brake cams and clamp surfaces at CS36 and CS38 on the clamps 36 and 38.

FIGS. 2*a* and 2*b* are views showing details of the actuating lever 20 and its associated linkage on an enlarged scale. When the cam dogs 16 and 18 of FIG. 1 are extended outward by centrifugal forces to strike surface 21 of the lever 20, the lever 20 is rotated about an axis through a pivot point 22 against the force of the spring S24. The rod 24 will be moved toward the left and its end will be pulled out of a bearing in the end of rod 26, in this view a bearing in the flattened portion 27 of the rod.

Figure 3A:
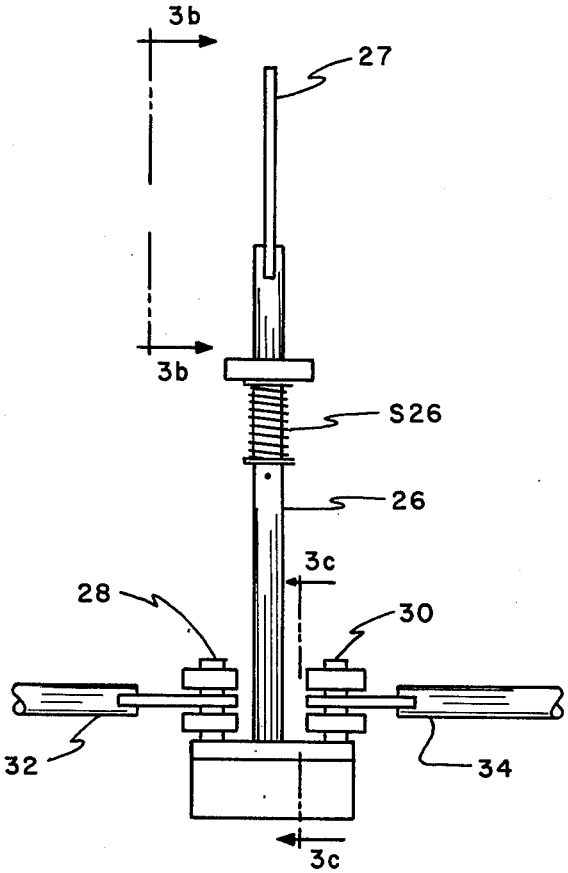
FIG. 3*a* depicts additional details of the linkage of FIG. 1 and particularly that between vertical and horizontal linkages.
Figure 3C:
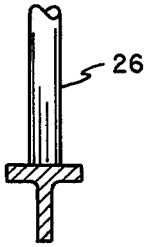

FIGS. 3*a*, 3*b* and 3*c* illustrate further details of the linkages of FIG. 1 and particularly details of linkages permitting the transfer of vertical motion to horizontal. In these views, after the rod 24 (shown in FIG. 1) has been removed from the opening in a bearing at 27', the rod 26 is forced downward by action of the spring S26, forcing the drive pins 28 and 30 free of bearings in the ends of the horizontal rods 32 and 34. This action releases the rods 32 and 34 so that they may, in turn, be forced outward by spring action as shown in FIGS. 1 and 4.

Figure 4:
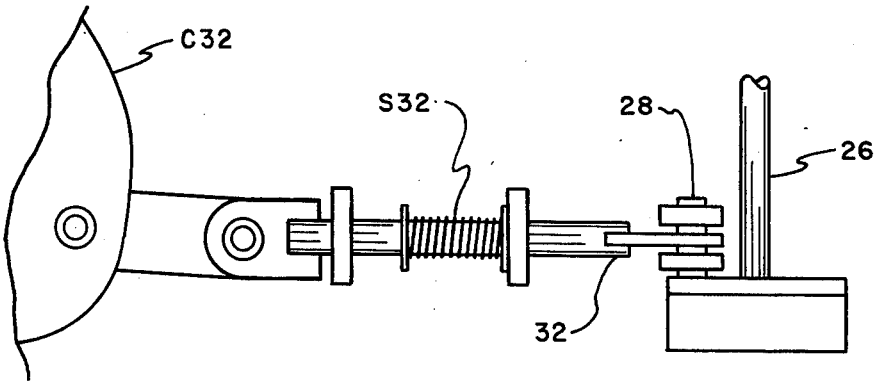
FIG. 4 is a detailed drawing showing connections between various linkages and a brake cam.

After release by the drive pin 28, the rod 32 in FIG. 4 is driven toward the left by action of the spring S32. This motion of rod 32 is translated to the cam C32, forcing it to rotate about an axis at A32 (FIG. 1) to brake the platform lift.

Figure 5:
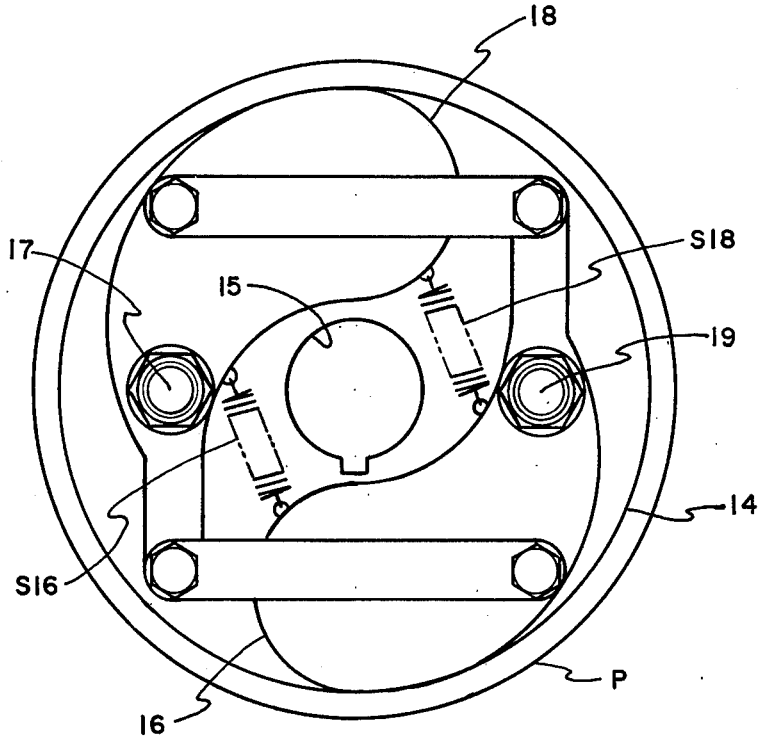
FIG. 5 is a plan view of an overspeed governor assembly in accordance with the invention.

FIG. 5 is a plan view of a portion of an overspeed governor assembly 14 showing details of the shape and arrangement of cam dogs 16 and 18 and the associated springs S16 and S18. This view depicts the governor when it is at rest. As the governor is turned about a central shaft through the opening 15, centrifugal forces acting on the dogs 16 and 18 will cause them to pull against the springs S16 and S18. When a critical speed is reached, the dogs will rotate about axes at 17 and 19 to an open position where they may strike the activating lever 20 to initiate the sequence of events resulting in braking the platform.

Figure 6:
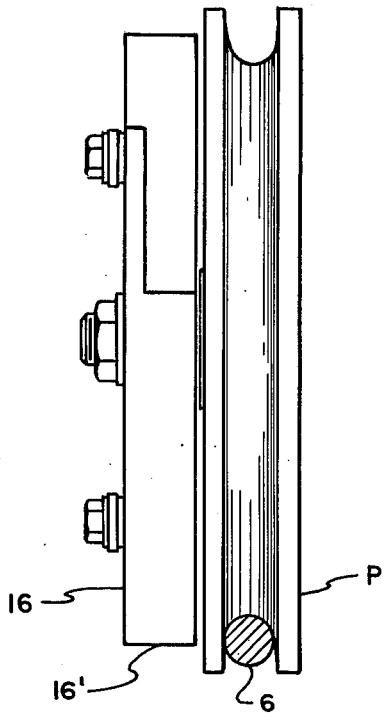
FIG. 6 is a side view of the assembly shown in FIG. 5.

FIG. 6 is a side view of the exemplary overspeed governor assembly 14 of FIG. 5. This Figure shows a side view of a cam dog 16 and a pulley P. The pulley engages the guide cable 6 to sense the speed at which the cable is moving past. Motion of the pulley is transmitted to the cam dogs causing them to rotate about a central shaft, as indicated before, and to engage the face 21 of the activating lever 20 when a preselected speed is exceeded. The broad face of the cam at 16' represents the portion of the cam 16 which strikes the similarly broad face 21 of the activating lever to initiate the braking action.

Figure 7:
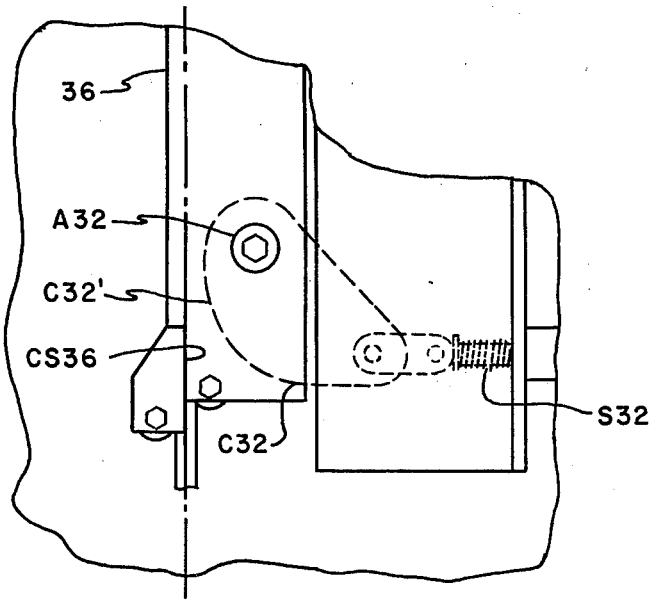
FIG. 7 is a detailed view illustrating relationships between elements of the brake mechanism.

FIG. 7 is a detailed view showing further relationships from FIG. 1 between the brake cam C32, the clamp 36, the spring S32 and other elements, including the clamp surface CS36. From this view, relationships between the disclosed elements should be clearer. In particular, it will be apparent that the edge C32' of the cam C32 will engage the lift cable 6 and press it against the clamp surface CS36 to slow down and stop motion of the platform when the governor is activated. In a preferred embodiment, the surface along the edge C32' is perpendicular to the sides of the cam C32, but it will be recognized that this surface may be hollow ground, or otherwise shaped, to make better contact with the cable and bind the cable against the clamp surface CS36.

Figure 8:
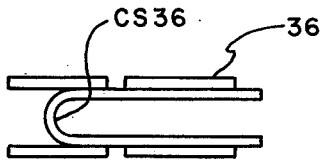
FIG. 8 is an end view of a brake clamp according to the invention.

FIG. 8 is an end view of the clamp 36. In this view it is noted particularly that the surface CS36 of the clamp is shaped to receive a round cable. This clamp surface is preferably sized to permit a cable, such as the guide cable 6 of FIG. 1, to pass therethrough with minimal friction. This same surface CS36 serves as part of the brake when a cam such as C32 is turned to force the cable against the surface CS36.

While the principles of the invention have been described above in connection with specific apparatus and applications, it is to be understood that this description is made only by way of example and not as a limitation on the scope of the invention.

I claim:

1. A braking system in association with a lift platform having a movable lift cable for translating said lift platform and having at least one stationary guide member separate and spaced apart from said lift cable for aligning said lift platform, said system comprising a governor mounted to said lift platform and operatively engaging said guide member and said governor being coupled through a linkage to brake means, said linkage including a plurality of spring loaded elements locked together by pin means and terminating in said brake means, said brake means including a first cam surface element pivotally mounted to said lift platform and operable by said linkage to lock said guide member between said first cam surface and a second cam surface element fixedly mounted to said lift platform, said governor responding to the translation of said lift platform when the speed of said lift platform relative to said guide member exceeds a predetermined maximum, to release said pin means and permit springs associated with said spring loaded elements to apply a force through said linkage to said brake means thereby to rotate said first cam surface element into engagement with said guide means and stop motion of said lift platform.

2. The invention as claimed in claim 1, in which the governor includes a sheave supporting a cam dog, and means holding said cam dog in an inoperative state under normal speed conditions of said platform, said cam dog responding to centrifugal force to move into a position to energize said linkage and said brake means when the speed of the platform exceeds said prescribed maximum.

3. The invention as claimed in claim 1, in which the governor bears a spring biased cam, said cam is responsive to a centrifugal force generated when the platform speed exceeds the prescribed maximum to energize an activating lever forming part of said linkage, and said activating lever includes means to release spring elements in said linkage and operate said brake means.

4. The invention as claimed in claim 1, in which said guide member is a cable and the first cam surface is enabled to lock said cable between itself and the second cam surface.

5. A braking system for a lift platform having amovable lift cable for translating said lift platform and having at least one stationary guide member separate and spaced apart from said lift cable for aligning said lift platform, said system comprising a governor mounted to said lift platform and operatively engaging said guide member and said governor being coupled by linkage means to brake means, said linkage means including an activating lever and a plurality of spring loaded elements locked together by pin means and terminating in said brake means, said brake means including a first cam surface element pivotally mounted to said lift platform and operable to lock said guide member between itself and a second cam surface element fixedly mounted to said lift platform, said governor responding to the translation of said lift platform when the speed of said lift platform relative to said guide member exceeds a predetermined maximum to operate said activating lever, causing said pin means to release said spring loaded elements and rotate said first cam surface element into engagement with said guide means thereby to operate said brake means to cause said lift platform to stop.

6. The invention as claimed in claim 5, in which the governor includes a sheave supporting a cam dog, and means holding said cam dog in an inoperative state under normal speed conditions of said platform, said cam dog including a means enabling the cam dog to be flung by centrifugal force into a position to energize said linkage and said brake means when the speed of the platform exceeds said prescribed maximum.

7. The invention as claimed in claim 5, in which the governor bears a spring biased cam, said cam is responsive to a centrifugal force generated when the platform speed exceeds the prescribed maximum to energize an activating lever forming part of said linkage, and said activating lever includes means to release spring elements in said linkage and operate said brake means.

8. The invention as claimed in claim 5, in which said guide member is a cable and the first cam surface is operable to lock said cable between itself and the second cam surface.

* * * * *